US009823046B1

(12) United States Patent
Zajac et al.

(10) Patent No.: US 9,823,046 B1
(45) Date of Patent: Nov. 21, 2017

(54) BOW SIGHTING SYSTEM

(71) Applicants: Robert Zajac, Lyles, TN (US); Sheryl Zajac, Lyles, TN (US)

(72) Inventors: Robert Zajac, Lyles, TN (US); Sheryl Zajac, Lyles, TN (US)

( * ) Notice: Subject to any disclaimer, the term of this patent is extended or adjusted under 35 U.S.C. 154(b) by 0 days.

(21) Appl. No.: 15/286,072

(22) Filed: Oct. 5, 2016

(51) Int. Cl.

| | |
|---|---|
| ***F42B 6/04*** | (2006.01) |
| ***F41G 1/467*** | (2006.01) |
| ***F41G 1/54*** | (2006.01) |
| ***F41G 1/35*** | (2006.01) |

(52) U.S. Cl.
CPC ..... *F41G 1/54* (2013.01); *F41G 1/35* (2013.01); *F41G 1/467* (2013.01); *F42B 6/04* (2013.01)

(58) Field of Classification Search
CPC .... F41G 1/467; F41B 5/14; F41B 6/04; F41B 6/08
See application file for complete search history.

(56) References Cited

U.S. PATENT DOCUMENTS

| | | | | |
|---|---|---|---|---|
| 6,134,793 | A | 10/2000 | Sauers | |
| 7,216,643 | B2 | 5/2007 | Pellerite | |
| 7,231,721 | B2 * | 6/2007 | Minica | F41B 5/143 124/87 |
| 7,325,319 | B2 | 2/2008 | Smith | |
| 7,409,770 | B2 | 8/2008 | Jones | |
| 8,251,845 | B2 | 8/2012 | Bay | |
| D674,864 | S | 1/2013 | Ward | |
| 2004/0014010 | A1 | 1/2004 | Swensen et al. | |

* cited by examiner

*Primary Examiner* — John Ricci

(57) ABSTRACT

A bow sighting system for sighting in a bow includes a bow that has a sight. An arrow is selectively shot from the bow. A laser unit is selectively coupled to the arrow. The laser may emit a visible beam of laser light and the arrow is positioned in the bow. Thus, the visible beam of laser light is aligned with the sight thereby facilitating the bow to be sighted in.

5 Claims, 4 Drawing Sheets

BOW SIGHTING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to sighting devices and more particularly pertains to a new sighting device for sighting in a bow.

BRIEF SUMMARY OF THE INVENTION

An embodiment of the disclosure meets the needs presented above by generally comprising a bow that has a sight. An arrow is selectively shot from the bow. A laser unit is selectively coupled to the arrow. The laser may emit a visible beam of laser light and the arrow is positioned in the bow. Thus, the visible beam of laser light is aligned with the sight thereby facilitating the bow to be sighted in.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
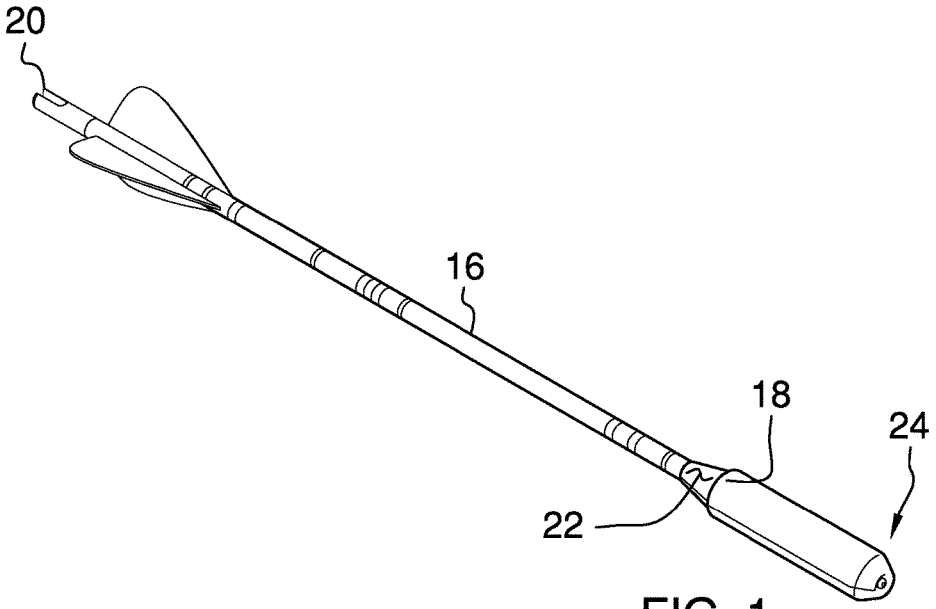
FIG. 1 is a perspective view of a bow sighting system according to an embodiment of the disclosure.
Figure 2:
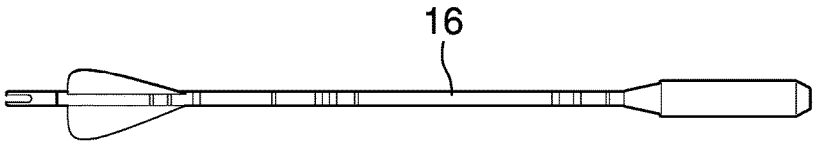
FIG. 2 is a right side view of an embodiment of the disclosure.
Figure 3:
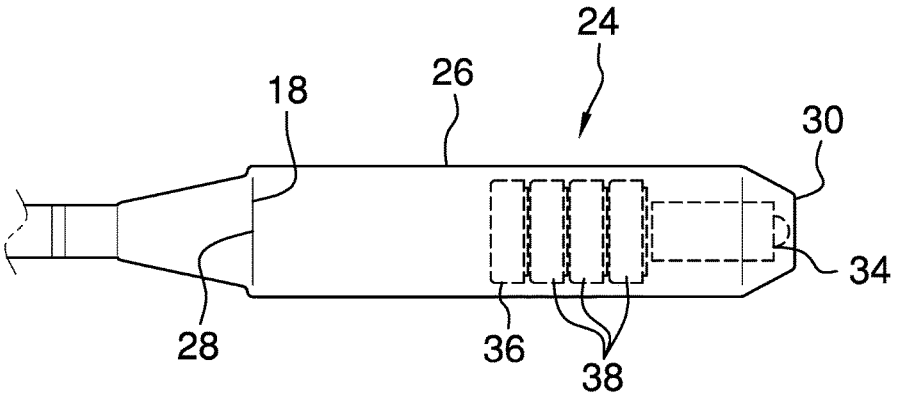
FIG. 3 is a right side phantom view of an embodiment of the disclosure.
Figure 4:
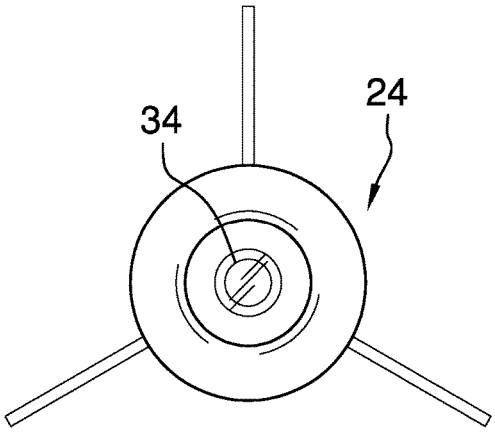
FIG. 4 is a front view of an embodiment of the disclosure.
Figure 5:
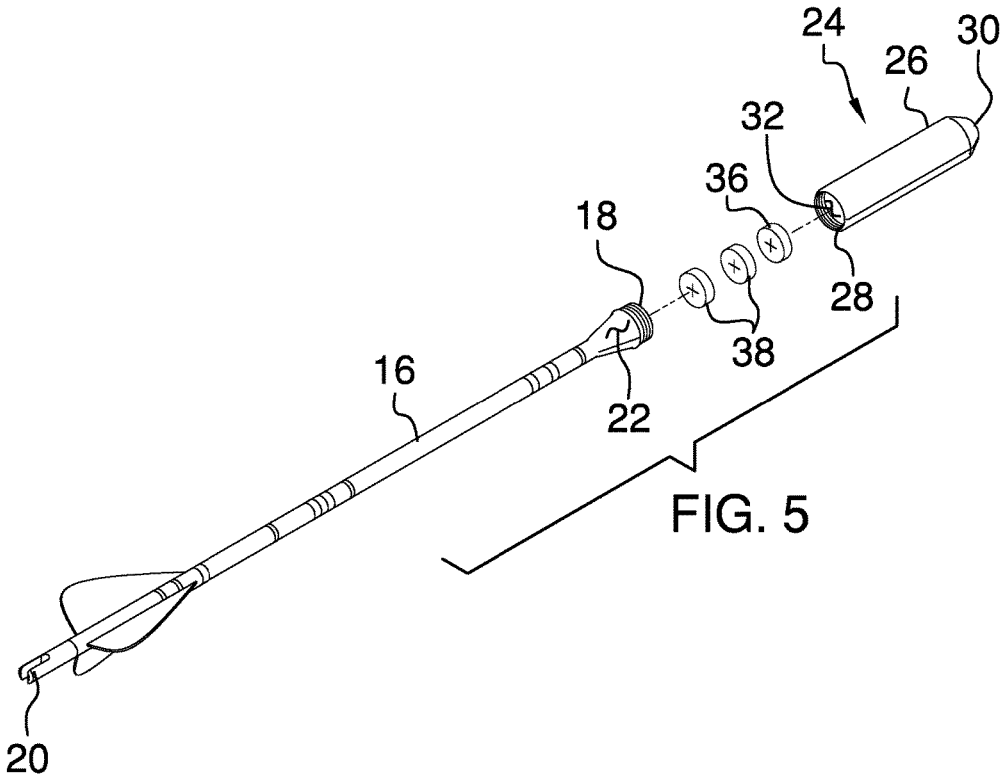
FIG. 5 is a perspective exploded view of an embodiment of the disclosure.
Figure 6:
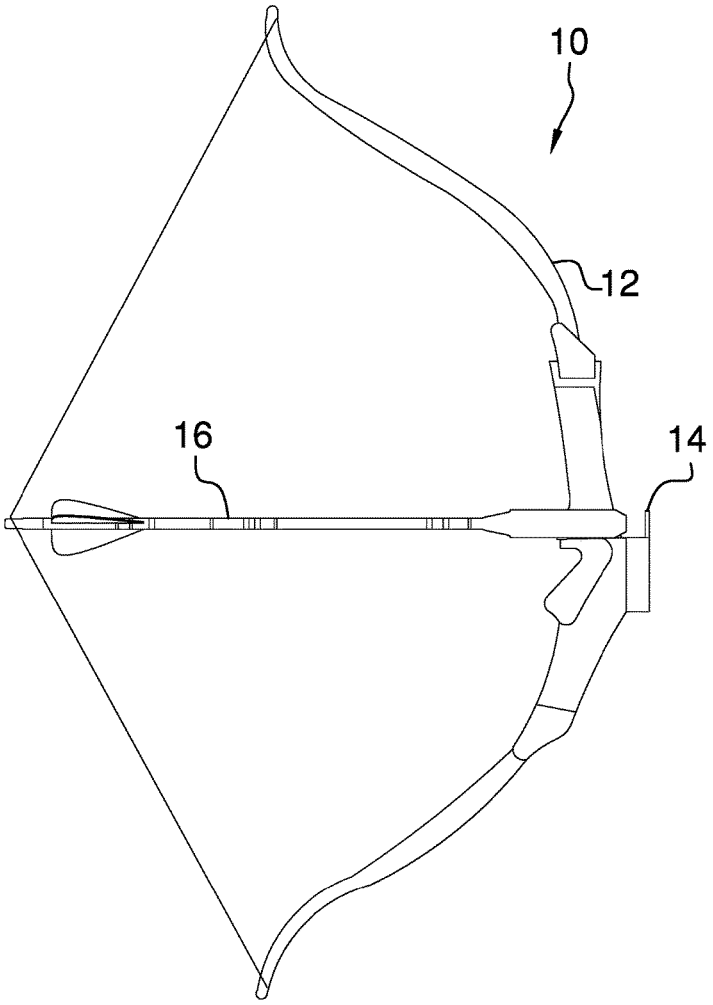
FIG. 6 is a perspective in-use view of an embodiment of the disclosure.

With reference now to the drawings, and in particular to FIGS. 1 through 6 thereof, a new sighting device embodying the principles and concepts of an embodiment of the disclosure and generally designated by the reference numeral 10 will be described.

As best illustrated in FIGS. 1 through 6, the bow sighting system 10 generally comprises a bow 12 hat has a sight 14. The bow 12 may comprise a compound bow or a crossbow. The sight 14 may comprise a bow scope or open bow sights. An arrow 16 is provided. The arrow 16 is selectively shot from the bow 12.

The arrow 16 has a first end 18 and a second end 20. The first end 18 flares outwardly from a centerline of the arrow 16. Thus, the first end 18 has a diameter that is greater than a diameter of the second end 20. The arrow 16 has an outer surface 22 and the outer surface 22 is threaded adjacent to the first end 18. The second end 20 engages the bow 12.

A laser unit 24 is provided and the laser unit 24 is selectively coupled to the arrow 16. Thus, the laser unit 24 may emit a visible beam of laser light. The arrow 16 is positioned in the bow 12 such that the visible beam of laser light is aligned with the sight 14. Thus, the bow 12 may be sighted in.

The laser unit 24 comprises a cylinder 26 that has a first end 28 and a second end 30. The first end 28 is open and the cylinder 26 is substantially hollow. The cylinder 26 has an inner surface 32 and the inner surface 32 threadably engages the first end 28. Thus, the laser unit 24 is removably coupled to the arrow 16 having the cylinder 26 being coextensive with the arrow 16.

A laser 34 is provided and the laser 34 is coupled to the cylinder 26. The laser 34 is positioned on the second end 30 of the cylinder 26. Thus, the laser 34 may emit the visible beam of laser light outwardly from the second end 30 of the cylinder 26. The laser 34 may comprise have an operational power of 5 mW and a electromagnetic frequency of 532 nm·nd A power supply 36 is provided and the power supply 36 is removably positioned within the cylinder 26. The power supply 36 is electrically coupled to the laser 34 when the cylinder 26 is removably coupled to the arrow 16. Thus, the laser 34 turns on. The power supply 36 comprises at least one battery 38.

In use, the cylinder 26 is threadably coupled to the arrow 16. Thus, the laser 34 emits the visible beam of laser light from the second end 30 of the cylinder 26. The arrow 16 is positioned in the bow 12. The sight 14 is manipulated to align the sight 14 with the visible beam of laser light. Thus, the bow 12 is sighted to shoot accurately.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A bow sighting system comprising:

a bow having a sight;

an arrow being configured to be shot from said bow, said arrow having a first end and a second end, said first end flaring outwardly from a centerline of said arrow such that said first end has a diameter being greater than a diameter of said second end, said arrow having an outer surface, said outer surface being threaded adjacent to said first end, said second end engaging said bow; and a laser unit being selectively coupled to said arrow wherein said laser is configured to emit a visible beam of laser light, said arrow being positioned in said bow wherein the visible beam of laser light is aligned with said sight thereby facilitating said bow to be sighted in.

2. A bow sighting system comprising:

a bow having a sight;

an arrow being configured to be shot from said bow;

a laser unit being selectively coupled to said arrow wherein said laser is configured to emit a visible beam of laser light, said arrow being positioned in said bow wherein the visible beam of laser light is aligned with said sight thereby facilitating said bow to be sighted in; and said laser unit comprises a cylinder having a first end and a second end, said first end being open, said cylinder being substantially hollow, said cylinder having an inner surface, said inner surface threadably engaging said first end of said arrow such that said laser unit is removably coupled to said arrow having said cylinder being coextensive with said arrow.

3. The assembly according to claim 2, further comprising a laser being coupled to said cylinder, said laser being positioned on said second end wherein said laser is configured to emit the laser light outwardly from said second end.

4. The assembly according to claim 3, further comprising a power supply being removably positioned within said cylinder, said power supply being electrically coupled to said laser when said cylinder is removably coupled to said arrow such that said laser turns on, said power supply comprising at least one battery.

5. A bow sighting system comprising:

a bow having a sight;

an arrow being configured to be shot from said bow, said arrow having a first end and a second end, said first end flaring outwardly from a centerline of said arrow such that said first end has a diameter being greater than a diameter of said second end, said arrow having an outer surface, said outer surface being threaded adjacent to said first end, said second end engaging said bow; and a laser unit being selectively coupled to said arrow wherein said laser is configured to emit a visible beam of laser light, said arrow being positioned in said bow wherein the visible beam of laser light is aligned with said sight thereby facilitating said bow to be sighted in, said laser unit comprising:

a cylinder having a first end and a second end, said first end being open, said cylinder being substantially hollow, said cylinder having an inner surface, said inner surface threadably engaging said first end such that said laser unit is removably coupled to said arrow having said cylinder being coextensive with said arrow, a laser being coupled to said cylinder, said laser being positioned on said second end wherein said laser is configured to emit the laser light outwardly from said second end, and a power supply being removably positioned within said cylinder, said power supply being electrically coupled to said laser when said cylinder is removably coupled to said arrow such that said laser turns on, said power supply comprising at least one battery.

* * * * *